US008525108B2

(12) United States Patent
Hashimoto et al.

(10) Patent No.: US 8,525,108 B2
(45) Date of Patent: Sep. 3, 2013

(54) MASS SPECTROMETER

(75) Inventors: Yuichiro Hashimoto, Tachikawa (JP); Hideki Hasegawa, Tachikawa (JP); Masuyuki Sugiyama, Hino (JP)

(73) Assignee: Hitachi High-Technologies Corporation, Tokyo (JP)

( * ) Notice: Subject to any disclaimer, the term of this patent is extended or adjusted under 35 U.S.C. 154(b) by 247 days.

(21) Appl. No.: 13/058,054

(22) PCT Filed: Aug. 25, 2009

(86) PCT No.: PCT/JP2009/004085

§ 371 (c)(1),
(2), (4) Date: Feb. 8, 2011

(87) PCT Pub. No.: WO2010/023873

PCT Pub. Date: Mar. 4, 2010

(65) Prior Publication Data

US 2011/0133075 A1 Jun. 9, 2011

(30) Foreign Application Priority Data

Aug. 29, 2008 (JP) ..... 2008-220788

(51) Int. Cl.
*H01J 49/00* (2006.01)

(52) U.S. Cl.
USPC ..... 250/283; 250/281; 250/282; 250/290; 250/293

(58) Field of Classification Search
USPC ..... 250/281–283, 290–293
See application file for complete search history.

(56) References Cited

U.S. PATENT DOCUMENTS

| | | | | |
|---|---|---|---|---|
| 5,783,824 | A * | 7/1998 | Baba et al. | 250/281 |
| 5,847,386 | A | 12/1998 | Thomson et al. | |
| 6,177,668 | B1 | 1/2001 | Hager | |
| 7,049,580 | B2 | 5/2006 | Londry et al. | |
| 2007/0181804 | A1 * | 8/2007 | Hashimoto et al. | 250/290 |
| 2008/0116372 | A1 | 5/2008 | Hashimoto et al. | |
| 2008/0121795 | A1 | 5/2008 | Sugiyama et al. | |

FOREIGN PATENT DOCUMENTS

| | | | |
|---|---|---|---|
| JP | 10-21871 | A | 1/1998 |
| JP | 2008-130401 | A | 6/2008 |
| JP | 2008-130469 | A | 6/2008 |
| WO | 2007/052372 | A1 | 5/2007 |

* cited by examiner

*Primary Examiner* — Michael Maskell
(74) *Attorney, Agent, or Firm* — Mattingly & Malur, PC

(57) ABSTRACT

The mass spectrometer is characterized in that a linear ion trap, that consists of electrodes for mass-selective discharge, is provided with a mechanism that excites ions in a first direction that is perpendicular to the rod axes and a mechanism that simultaneously generates an electric field on the axes in a second direction that is perpendicular to the axial direction and the first direction in order to generate an electric field on the central axis. Highly efficient, high-speed scanning can be achieved using this configuration.

13 Claims, 10 Drawing Sheets

MASS SPECTROMETER

TECHNICAL FIELD

The present invention relates to a mass spectrometer.

BACKGROUND ART

In mass spectrometry apparatuses, ion traps having high sensitive characteristics have been widely employed. Among these ion traps, since ion amounts which can be trapped at once (trapping capacities) into linear ion traps constructed of 4 pieces of rod electrodes are large, as compared with those of conventional three-dimensional traps (on the order of 1,000 to 10,000 pieces), the linear ion traps can perform high-sensitivity analyses and have been widely employed.

Patent Literature 1 describes a method for mass-selectively ejecting ions of a specific mass along an axial direction of a rod set, which are resonant-excited along a radial direction within a linear ion trap, by utilizing the fringing fields generated at ends of the rods after the ions have been accumulated in the linear ion trap.

Patent Literature 2 describes the following method; after ions have been accumulated in a linear ion trap, DC voltages are applied to electrodes inserted between rod electrodes so as to form a harmonic potential on a center axis. Ions of a specific mass which are resonant-excited along an axial direction within this harmonic potential on the center axis are mass-selectively ejected along the axial direction of the rods.

Patent Literature 3 describes a method for mass-selectively ejecting ions of a specific mass along an axial direction of the rod electrodes, which are resonant-excited along a radial direction within a linear ion trap, by utilizing a DC voltage applied between wire electrodes inserted between the rod electrodes after the ions have been accumulated in the linear ion trap.

Patent Literature 4 describes several methods capable of producing electric fields along axial directions of rod electrodes. For instance, the electric fields can be produced on the center axes by employing taper-shaped rod electrodes, employing rods which are not parallel to each other, employing rods having resistivities as the rod electrodes, or employing other electrodes between the rod electrodes, so that a potential for moving ions along the axial directions can be formed.

Furthermore, Patent Literature 1 describes that by adding these methods described in Patent Literature 4, ions are converged to a specific portion on the center axis and the ejection efficiency of the ions is increased.

Patent Literature 5 describes that vane electrodes whose distances from a center axis vary along axial positions are inserted among the respective rod electrodes which constitute a linear ion trap and collision-induced dissociation of the ions is performed. There is described that with employment of this collision-induced dissociation, even when buffer gas pressure is low, the dissociation is more effectively progressed.

CITATION LIST

Patent Literatures

Patent Literature 1: U.S. Pat. No. 6,177,668
Patent Literature 2: U.S. Pat. No. 5,783,824
Patent Literature 3: WO 2007/052372
Patent Literature 4: U.S. Pat. No. 5,847,386
Patent Literature 5: U.S. Pat. No. 7,049,580

SUMMARY OF INVENTION

Technical Problem

In Patent Literature 1, since the distribution of the ions is broadened along the axial direction when the ions are mass-selectively ejected from the linear ion trap along the axial direction, there is a problem that the ejection efficiency is low when the ions are ejected in a high speed. Moreover, to this purpose, Patent Literature 1 describes that the method thereof is combined with the method of Patent Literature 4. However, in this case, another problem occurs in that the potential of the mass selection is largely distorted, and thus, the mass resolution cannot be obtained.

In Patent Literature 2, since the DC electric field along the axial direction for selecting the mass is dissociated from the harmonic potential, there is such a problem that the sufficient mass resolution cannot be obtained.

In Patent Literature 3, since the distribution of the ions is broadened along the axial direction when the ions are mass-selectively ejected from the linear ion trap along the axial direction, there is a problem that the ejection efficiency is low when the ions are ejected in a high speed.

Patent Literature 4 does not describe the method for mass-selectively ejecting the ions from the linear ion trap along the axial direction.

Patent Literature 5 does not describe the method for improving the performance when the ions are mass-selectively ejected.

An objective of the present invention is to provide a linear ion trap capable of mass-selectively ejecting ions along an axial direction in a high ejection efficiency without lowering mass resolution even during high speed scanning.

Solution to Problem

A mass spectrometry apparatus is featured by that in a linear ion trap constructed of quadrupole rod electrodes for performing mass-selective ejection, a mechanism is provided which excites ions along a first direction perpendicular to a rod axis, and at the same time, produces an on-axis electric field along a second direction which is orthogonally intersected with both an axial direction and the first direction, so that an electric field is formed on a center axis.

Advantageous Effects of Invention

In accordance with the ion trap of the present invention, a trapping capacity and mass precision are compatible with each other.

BRIEF DESCRIPTION OF DRAWINGS

FIG. 7(*b*) The fifth embodiment of the present system.

DESCRIPTION OF EMBODIMENTS

Embodiment 1

Figure 1:
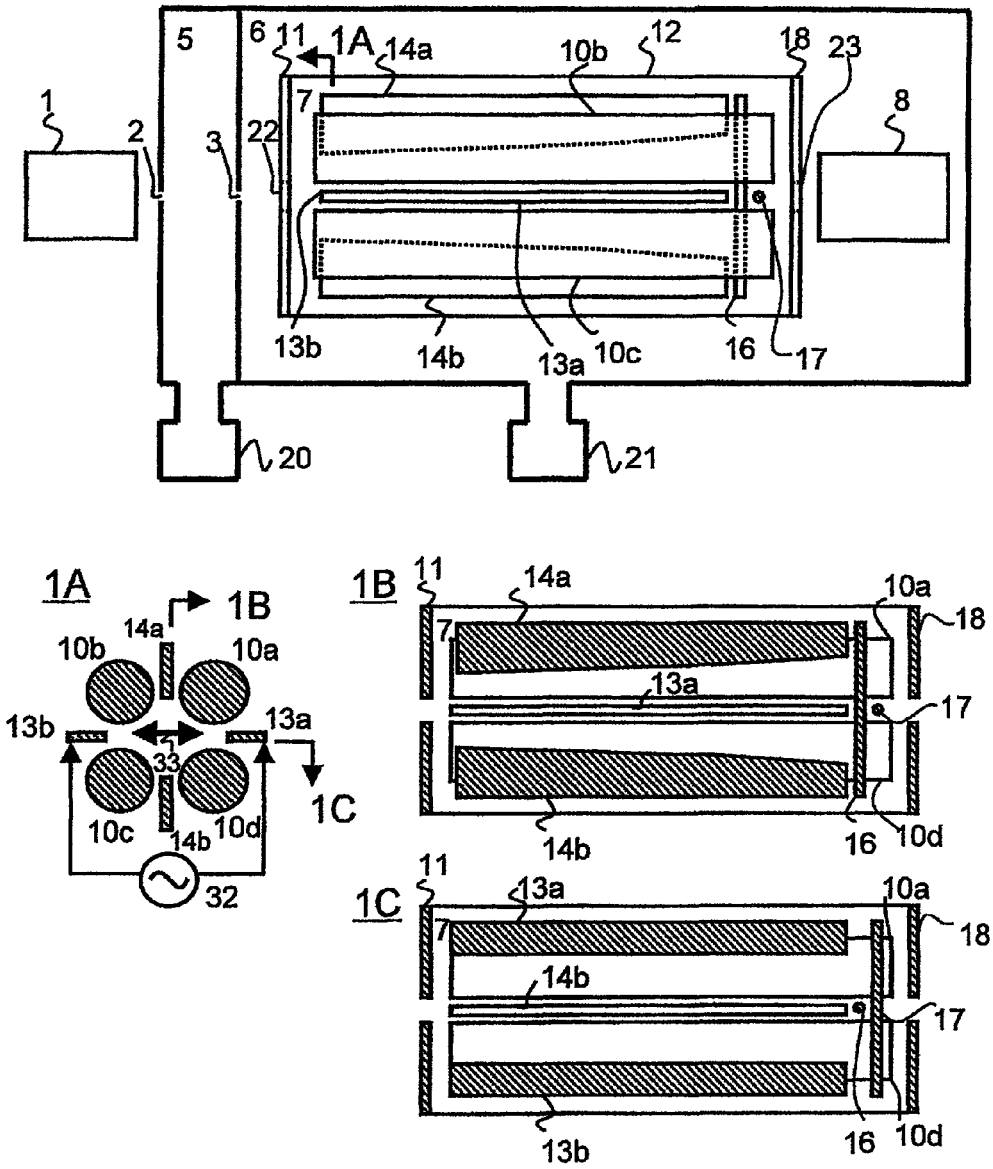
FIG. 1 A first embodiment of a present system.

FIG. 1 is a structural diagram of a linear ion trap to which the present system has been applied. In the case that a specific description is not made, positive ions are assumed in the following descriptions. As to negative ions, although a polarity of a DC voltage is reversed, other operations are similar to those of the positive ions.

Ions produced in various ion sources 1 pass through a first narrow hole 2 and are introduced to a differentially-pumped section 5 exhausted by a vacuum pump 20. Thereafter, the ions pass through a second narrow hole 3, and are introduced to a vacuum chamber 6 exhausted by a vacuum pump 21 in $10^{-6}$ Torr to $10^{-4}$ Torr. Thereafter, the ions pass through a narrow hole 22, and are introduced to a linear ion trap chamber 7. While the linear ion trap chamber 7 is surrounded by an end electrode 11, an outer cylinder 12, and an end electrode 18, gases are introduced into its inside by a gas supplying unit (not shown). As supplying gases, rare gases such as helium and argon, nitrogen, and the like are employed. Pressure of the linear ion trap chamber 7 is maintained at on the order of $10^{-4}$ Torr to $10^{-2}$ Torr.

Firstly, ions introduced to the trap chamber 7 are introduced to a space surrounded by the end electrode 11, four pieces of rod electrodes 10, exciting-purpose vane electrodes 13, axial-direction potential forming-purpose vane electrodes 14, and a trap wire electrode 16. Along the axial direction of the rod electrodes 10, ions can be trapped by applying a DC voltage on the order of 2 to 30 V to the end electrode 11 and the trap wire electrode 16. It is preferable to employ each of the wire electrodes having a diameter smaller than or equal to 50 μm in order to prevent losses of ions, which are caused by collision of the ions.

A radio frequency voltage (on the order of 1 MHz, maximum amplitude of ±5 KV) whose phase is alternately inverted is applied to the rod electrodes 10. As a result, a pseudo harmonic potential is formed along a radial direction which is orthogonally intersected with the rod axial direction. As to ions trapped in the linear ion trap chamber, ions of a specific mass can be resonantly oscillated by applying an auxiliary AC voltage 32 (on the order of 300 KHz, maximum amplitude of ±100 V) between the oppositely-located exciting-purpose vane electrodes (13*a* and 13*b*). A corresponding relationship of mass of ions which are resonated with auxiliary AC frequencies has been described in Patent Literature 3. By applying the auxiliary AC voltage based upon this relationship, ions of the specific mass can be resonantly excited, and orbit amplitudes can be broadened along a direction 33.

Also, by inserting the axial-direction potential forming-purpose vane electrodes 14 having a shape whose distances from a rod center vary, a voltage can be formed on a quadrupole center axis. In FIG. 1, an example of this electrode shape is indicated. Since the axial-direction potential forming vane electrode 14 of FIG. 1 is located near the quadrupole center axis at an entrance side and far from the center axis at an exit side, when a positive DC voltage is applied, a potential at the entrance side of the quadrupole central axial can be set higher than a potential at the exit side thereof. By applying such a voltage, positive ions can be converged on the exit side. Also, if a negative DC voltage is applied, then positive ions can be conversely collected on the entrance side. As to the electrodes for forming the axial-direction electric fields, as shown in FIG. 1, electrodes which are located near the center axis at an entrance side are preferable in order to achieve an objective for minimizing disturbances of radial-direction electric fields of an exit portion. In the inside of the trap, after isolation, dissociation, and the like of ions are carried out, ions of a specific mass are resonantly excited by the auxiliary AC electric field formed between the exciting-purpose vane electrodes, overcome the potential of the trap wire electrode 16, pass through a narrow hole 23 of the end electrode 18 by an extracting electrode formed by an extracting wire electrode 17, and are detected by a detector 8.

Figure 2:
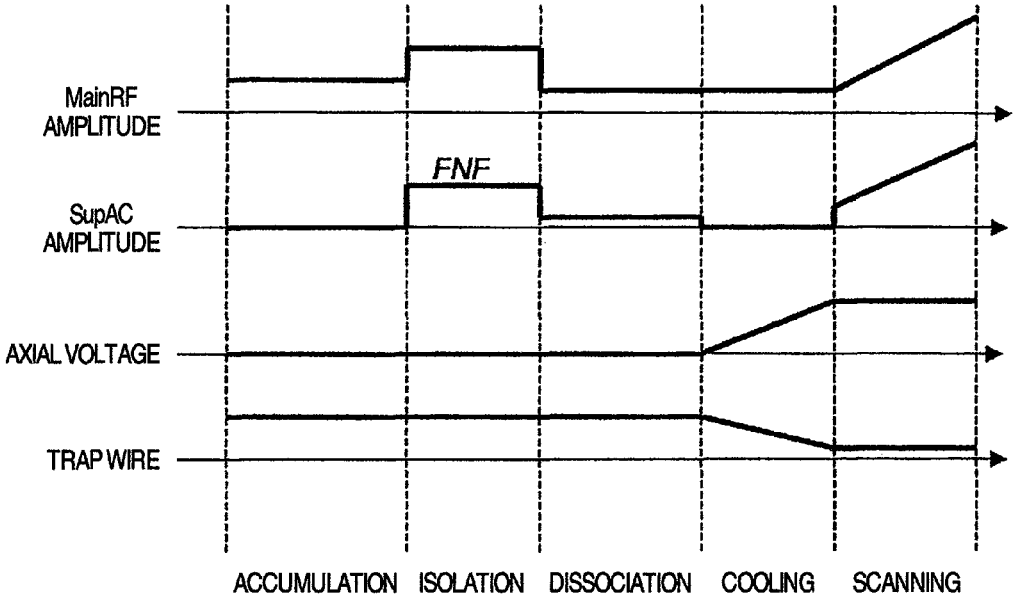
FIG. 2 A measuring sequence of the first embodiment of the present system.

A typical MS/MS measuring sequence in a linear ion trap is shown in FIG. 2. A MainRF amplitude shows an amplitude of a radio frequency voltage which is applied to the rod electrodes 10, an SupAC amplitude shows an amplitude value of an auxiliary AC voltage which is applied between the resonance exciting-purpose vane electrodes, and an axial voltage shows a DC voltage value which is applied to the axial-direction potential forming-purpose vane electrodes.

The measuring sequence is constituted by five steps of accumulation, isolation, dissociation, cooling, and scanning. In the accumulation step, ions supplied from the outside are stored. Next, the measuring sequence is advanced to such an isolation step that only ions of a specific mass are left inside the trap, and other ions are ejected to the outside. In this step, by applying a synthesized wave of radio frequency components called as "FNF" (synthesized wave of on the order of several KHz to several hundreds of KHz, and maximum of on the order of ±50 V) between the vane electrodes, the ions other than the ions of a specific mass are resonantly excited so as to be ejected to the outside. As a result, only the ions of the specific mass can be isolated within the trap. Next, the dissociation step is performed. As a dissociation method, collision dissociation is generally performed in which a buffer gas present within the trap is caused to collide with resonantly-excited ions. This collision dissociation can be realized by applying an auxiliary AC voltage of a specific frequency (on the order of several tens of KHz, and maximum of on the order of ±1 V) between the resonance exciting-purpose vane electrodes. Other than the collision dissociation, it is known that dissociation is advanced based upon electron transfer dissociation (ETD) in which negative ions are introduced so as to be reacted with positive ions, electron capture dissociation (EDD) or electron induced dissociation (EID) by introducing electrons, electron detachment dissociation (EDD) if they are negative ions, and so on. Also, it is possible to perform various sorts of ion molecule reactions by mixing a reactive gas into a buffer gas. Thereafter, the ions are advanced to the cooling step. In the cooling step, a DC voltage is applied to the axial-direction potential forming-purpose vane electrodes 14. As a result, the ions are converged to the vicinity of the exit. Thereafter, by sweeping the RF voltage and the auxiliary AC voltage (on the order of several hundreds of KHz, and on the order of ±10 V) respectively while forming of the axial-direction potential is maintained, the ions which have been trapped are ejected sequentially from ions of smaller masses to ions of larger masses. The larger mass of ions becomes, the harder the ions are ejected. As a result, making this axial voltage gradually greater during scanning may also become effective in order to increase the ejecting speed.

It should be noted that although the sequence of the MS/MS measurement has been indicated in the present embodiment, an MSn ($n \geqq 3$) measurement can be alternatively carried out by adding isolation steps and dissociation steps, and an MS measurement can be alternatively carried out by omitting these steps. Although the cooling step is positioned just before the scanning step in FIG. 2, the cooling step can be alternatively set at any timing other than the above timing. For example, by inserting the cooling step just before the dissociation step, the ions can be converged to a rear portion on the trap axis, or by applying a voltage having an opposite polarity, the ions can be alternatively converged to a front portion thereof. Density of the ions is increased by these operations and ion internal energy is activated, so that a dissociation efficiency of the ions can be increased.

Figure 3:
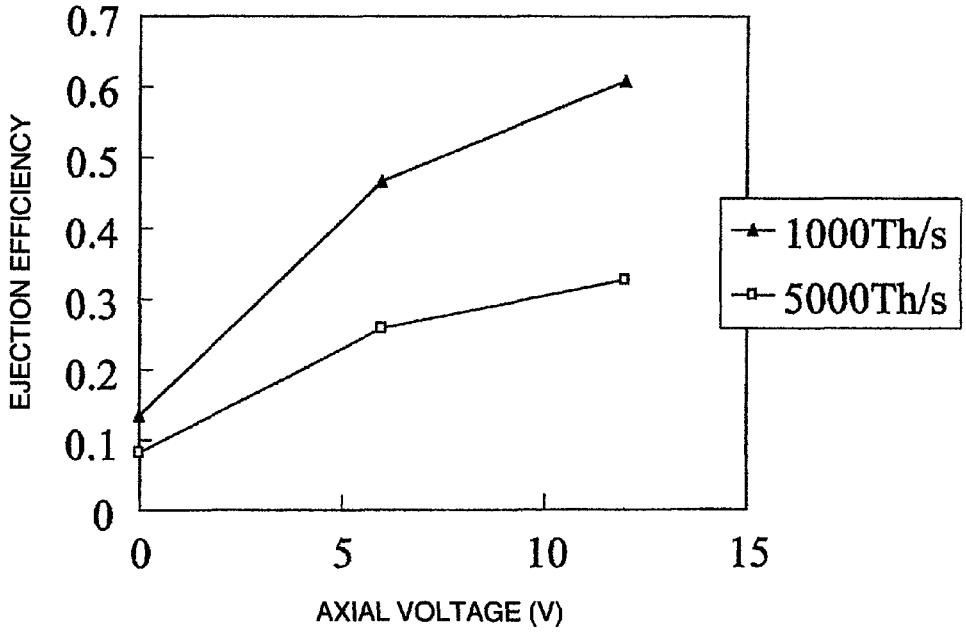
FIG. 3 An explanatory diagram of an effect of the first embodiment of the present system.

FIG. 3 shows results when ions are ejected in the case that the present system is employed. Ejection efficiencies regarding ions of m/z 609.3 are presented in the case that an axial-direction voltage is applied and not applied. As can be understood from FIG. 3, by applying the axial-direction voltage and converging the ions to an end portion, the ejection efficiency can be largely improved. An abscissa shows a magnitude of an axial voltage during ejection. In the case that the axial voltage was not applied, it was seen that the ejection efficiency could be improved approximately three times as high as that in a case that the axial voltage was applied.

Moreover, in this case, the deterioration of the mass resolution was not seen, which appears when the system of Patent Literature 1 is performed. This reason is given as follows. As shown in Patent Literature 1, in the case that the electrodes for forming the electric field on the center axis are inserted between the rod electrodes so as to perform the resonant excitation between the rod electrodes, the excitation direction and the insertion direction of the electrodes for forming the axial-direction electric field establish a relationship of 45 degrees. In case of 45 degrees, it is known that octapole components are mainly superposed due to symmetry. As a result, it can be presumed that the resonant conditions of the ions become broad, so that the deterioration of the mass resolution was seen.

On the other hand, in case of the present embodiment, the excitation direction and the insertion direction of the electrodes for forming the axial-direction electric field constitute 90 degrees. In the case that symmetry is considered similarly, it is obvious that components which receive changes are mainly quadrupole components. The quadrupole components cause only the shifts of mass but do not broaden the resonant conditions. As a consequence, it is possible to interpret that since the resonance excitation direction and the insertion direction of the axial-direction forming electrodes are orthogonally intersected with each other, a distortion of the radial-direction electric field is small when the axial-direction electric field is formed, so that lowering of the mass resolution is suppressed.

Embodiment 2

Figure 4:
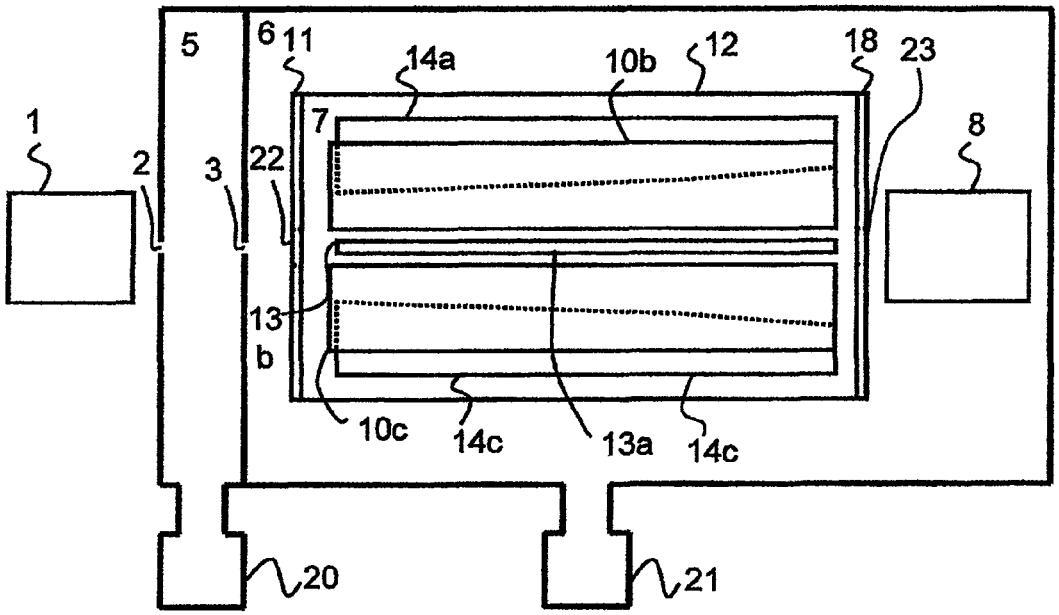
FIG. 4 A second embodiment of the present system.

FIG. 4 is a structural diagram of a linear ion trap of an embodiment 2 to which the present system has been applied. A system defined from an ion source to the linear ion trap is similar to that of the embodiment 1. As a difference, while a trap wire electrode and an extracting wire electrode are not present, a voltage having a positive polarity (from several V to several tens of V) is applied to the end electrode 23 in order to trap ions. The respective sequences of isolation, dissociation, and cooling may be carried out in a substantially same operation. Ions of a specific mass are resonantly excited by applying an auxiliary AC voltage between the exciting-purpose vane electrodes 14, and the resonated ions can be ejected by a fringing field. By sweeping the MainRF voltage and the auxiliary AC voltage (on the order of several hundreds of KHz, and on the order of ±10 V), the ions which have been trapped are ejected sequentially from ions of smaller masses to ions of larger masses. As a merit of the present embodiment, since the trap wire electrode and the extracting vane electrode can be omitted, its cost can be reduced. On the other hand, since the fringing field whose control is difficult is employed as the ejecting electric field, the ejection efficiency is better with the embodiment 1.

Embodiment 3

Figure 5:
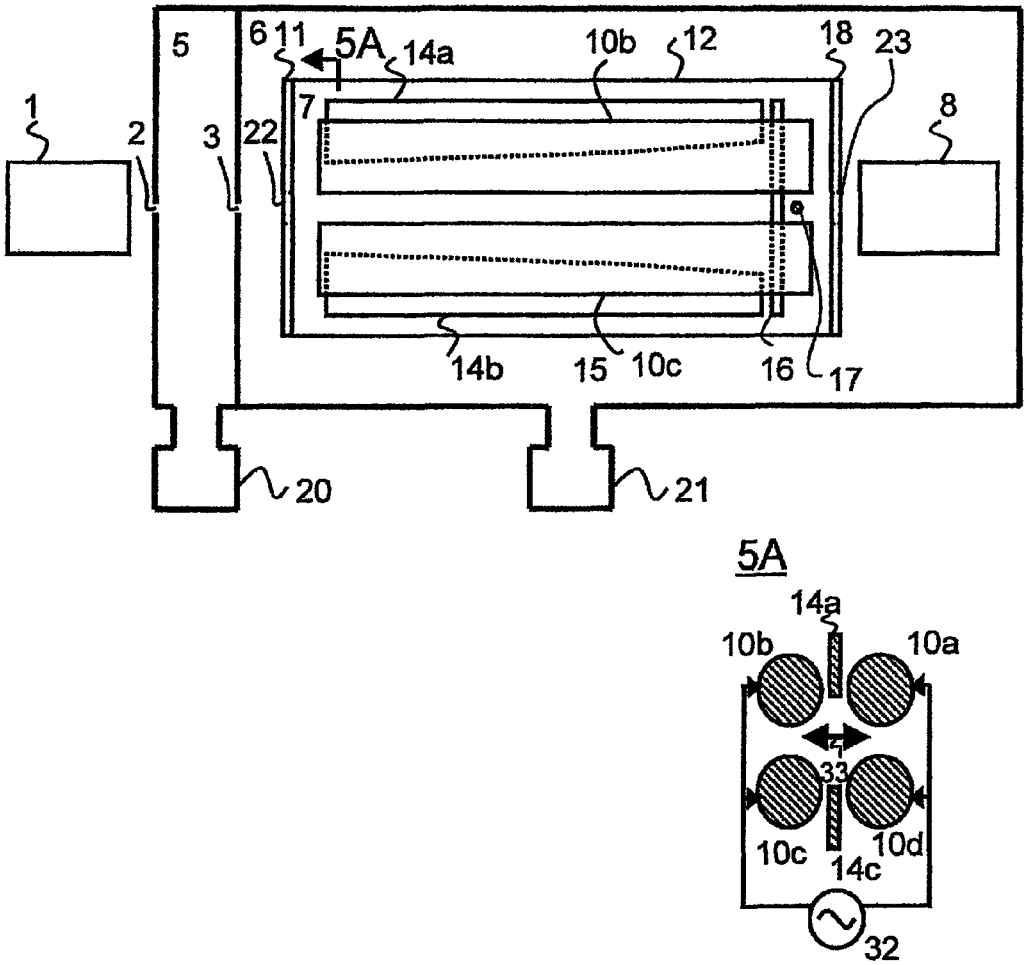
FIG. 5 A third embodiment of the present system.

FIG. 5 is a structural diagram of a linear ion trap of an embodiment 3 to which the present system has been applied. A system defined from an ion source to the linear ion trap is similar to that of the embodiment 1. As a difference, excitation vane electrodes are not used. Instead, auxiliary AC voltages are superposed between the rod electrodes 10*a*, 10*d* and the rod electrodes 10*b*, 10*c* respectively. As a result, ions of a specific mass can be resonantly excited along a direction of an arrow 33. An operation can be carried out in a similar manner to that of the embodiment 1. As a merit, since the exciting-purpose vane electrodes can be omitted, its cost can be reduced. On the other hand, since desirable voltages are produced by utilizing four-phase coils as coils and the like, a configuration of power supplies becomes complex, and there are some possibilities that adjustments may become cumbersome.

Embodiment 4

Figure 6:
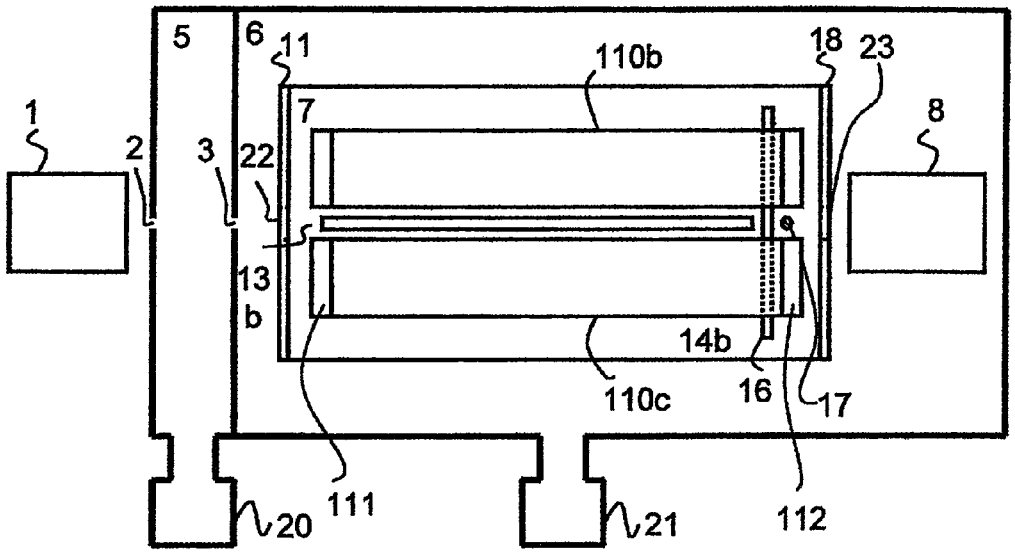
FIG. 6 A fourth embodiment of the present system.

FIG. 6 is a structural diagram of a linear ion trap of an embodiment 4 to which the present system has been applied. A system defined from an ion source to the linear ion trap is similar to that of the embodiment 1. In the embodiment 4, in order to form an axial-direction electric field, end rod electrodes 111 and 112 made of metal are disposed at both ends of the rods, and electrically conductive rods 110 are employed between the end rod electrodes. By applying an axial-direction voltage between the end rod electrodes 111 and 112, a similar effect to that of the embodiment 1 can be achieved. As the electrically conductive rod electrodes 110, various types of rod electrodes may be used: e.g., a type of rod electrodes in which an electrically conductive substance is coated on insulating rods, another type of rod electrodes in which an insulating layer is coated on metal rods, and furthermore, the electrically conductive coating is applied on the insulating layer. As a merit of the embodiment 4, since the axial-direction potential forming-purpose vane electrodes can be omitted, its cost can be reduced. On the other hand, there are some possibilities that due to voltage drops of the electrically conductive portions, strengths of quadrupole electric fields in the inner portions thereof are not uniform.

Although the above-described embodiments are accomplished by the measuring sequence indicated in the embodiment 1, mass scanning may be alternatively carried out at the same time while ions are accumulated in addition to the above-described measuring sequence. As a result, a duty cycle of the measurement can be improved and the sensitivity can be increased.

Embodiment 5

Figure 7A:
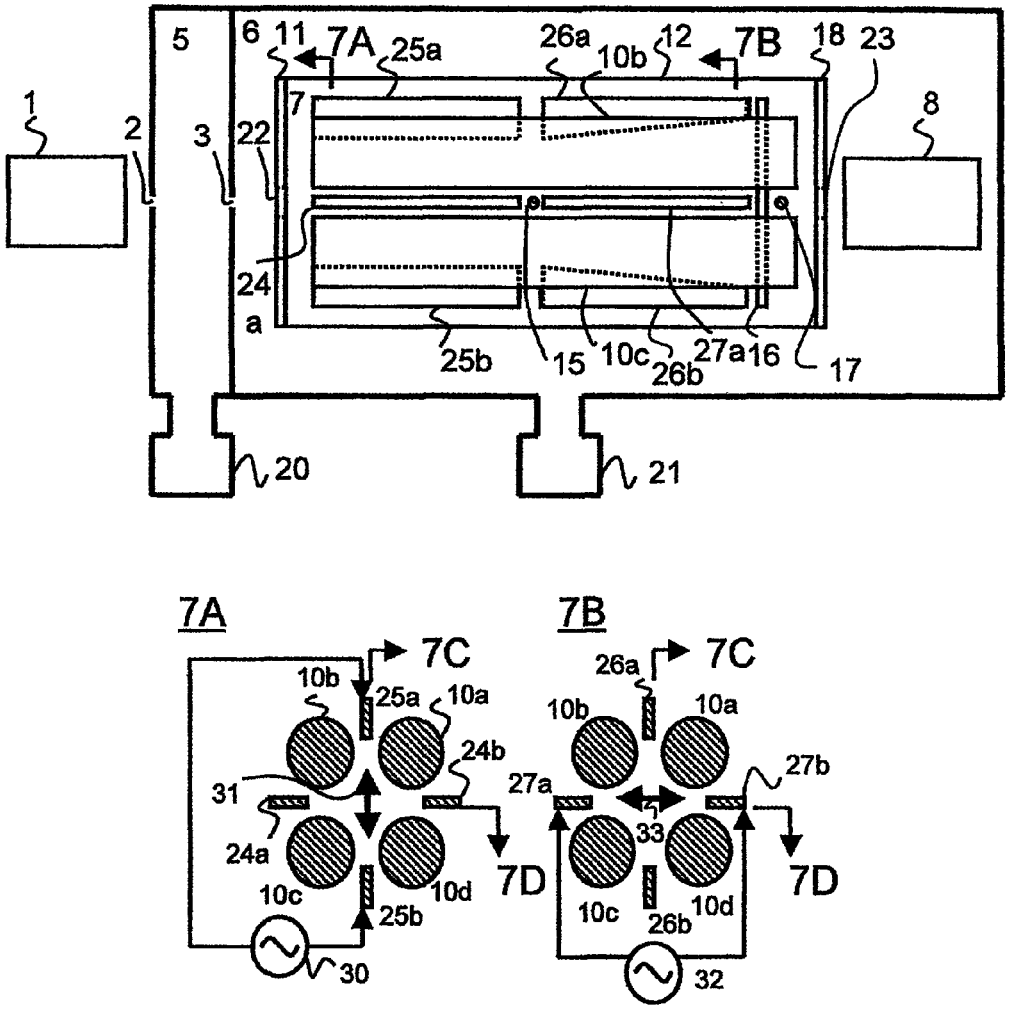
FIG. 7(*a*) A fifth embodiment of the present system.
Figure 7B:
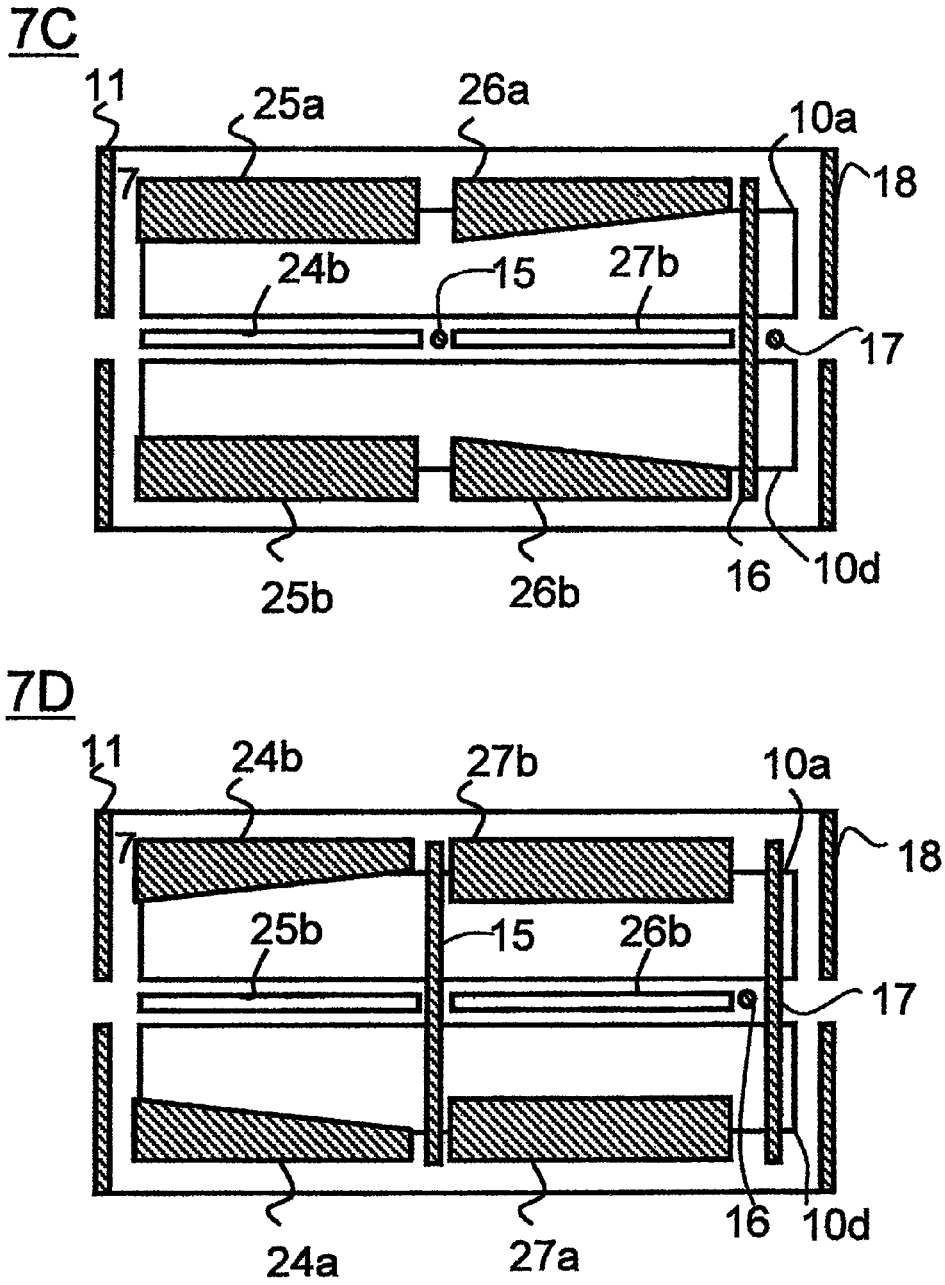

FIG. 7 is a structural diagram of a linear ion trap of an embodiment 5 to which the present system has been applied. Although a system defined from an ion source to the linear ion trap is similar to that of the embodiment 1, the trap is divided in two sections.

Firstly, ions introduced to a trap chamber 7 are introduced to a space surrounded by an end electrode 11, four pieces of rod electrodes 10, axial-direction potential forming-purpose vane electrodes 24, exciting-purpose vane electrodes 25, and a trap wire electrode 15 (defined as a first trap section). Along an axial direction of the rod electrodes 10, ions can be trapped by applying a DC voltage on the order of 2 to 30 V to the end electrode 11 and the trap wire electrode 15. It is preferable to employ each of the wire electrodes having a diameter smaller than or equal to 50 μm in order to prevent losses of ions, which are caused by collision of the ions. A radio frequency voltage (on the order of 1 MHz, maximum of ±5 KV) whose phase is alternately inverted is applied to the rod electrodes 10. As a result, a pseudo harmonic potential is formed along a radial direction which is orthogonally intersected with the rod axial direction.

As to ions trapped in the first trap section, ions of a specific mass can be resonantly oscillated by applying an auxiliary AC voltage 30 (on the order of 300 KHz, maximum amplitude of ±100 V) between the oppositely-located exciting-purpose vane electrodes (25*a* and 25*b*). A corresponding relationship of mass of ions which are resonated with auxiliary AC frequencies has been described in Patent Literature 3. By applying the auxiliary AC voltage based upon this relationship, ions of the specific mass are resonantly excited sequentially, and overcome the potential of the trap wire electrode 15 to be mass-selectively ejected from the first trap section.

The ions ejected from the first trap section are introduced to a space surrounded by the trap wire electrode 15, four pieces of the rod electrodes 10, axial-direction potential forming-purpose vane electrodes 26, resonance exciting-purpose vane electrodes 27, and a trap wire electrode 16 (defined as a second trap section). Along the axial direction, ions can be trapped by applying a DC voltage on the order of 1 to 20 V to the trap wire electrode 15 and the extracting wire electrode 16. A radio frequency voltage (on the order of 1 MHz, maximum of ±5 KV) whose phase is alternately inverted is applied to the rod electrodes 10. As a result, a pseudo harmonic potential is formed along the radial direction which is orthogonally intersected with the rod axial direction.

As to the ions trapped in the second trap section, ions of a specific mass can be resonantly oscillated by applying an auxiliary AC voltage 32 (on the order of 300 KHz, maximum amplitude of ±100 V) between the oppositely-located exciting-purpose vane electrodes (27*a* and 27*b*).

During the mass scanning, since the ions of the first trap and the second trap are converged to the end portions by applying the DC voltages to the axial-direction potential forming-purpose vane electrodes 24 and 26, respectively, the respective ejection efficiencies can be increased. At this time, it is effective to set an ion excitation direction 31 of the first trap section and an ion excitation direction 33 of the second trap section to orthogonal directions. This reason will be described below.

The ions excited in the first trap section are excited along the direction 31, and thereafter, are introduced to the second trap section in which ion cooling is progressed. In order to obtain superior mass resolution in the second trap section, an initial energy distribution of ions along the resonance excitation direction is required to be small. However, if a cooling time is set to a long time for this purpose, then there is a problem that a sufficient duty cycle cannot be obtained. In order that the cooling time is shortened and the cooling is sufficiently carried out, it is effective that the excitation direction of the first trap section is orthogonally intersected with the excitation direction of the second trap section.

Figure 8:
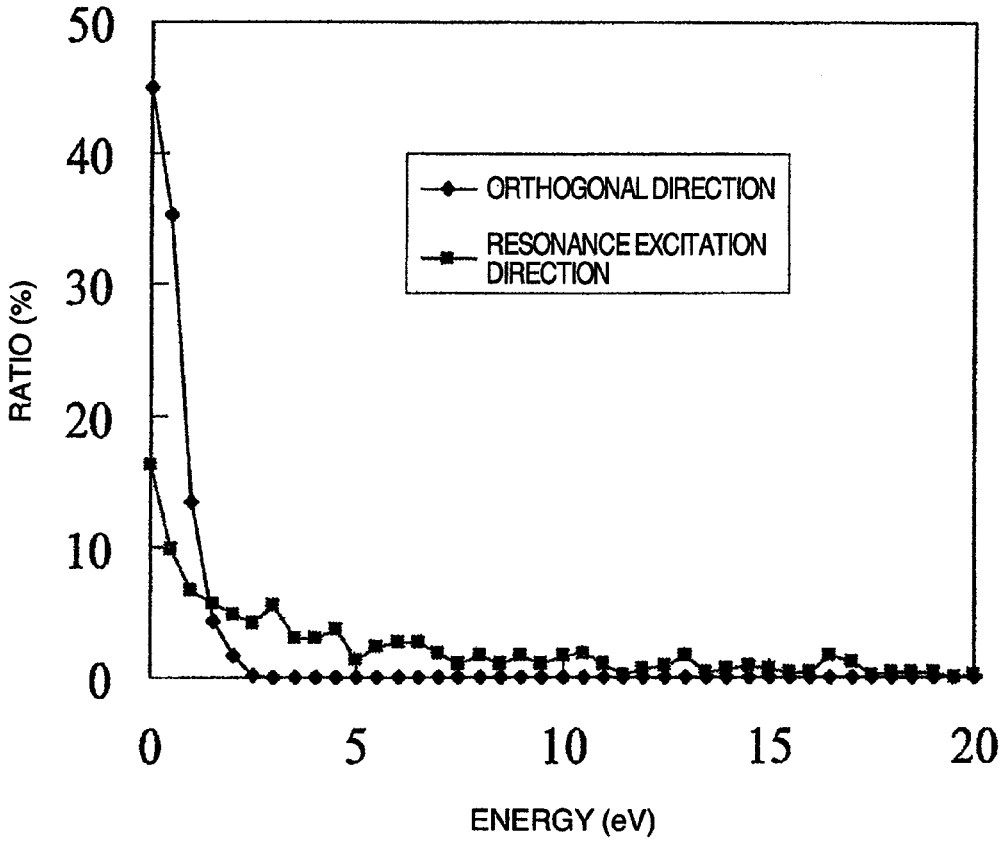
FIG. 8 An explanatory diagram of an effect of the fifth embodiment of the present system.

FIG. 8 shows energy distributions of ejected ions in an excitation direction and a direction orthogonal to it. The ions ejected from the first trap have a large energy distribution of 5.6 eV with respect to the excitation direction 31, but are converged to an energy distribution of 0.4 eV along the direction perpendicular to it which is smaller by approximately 1/10. As a result, as to a time required in the subsequent cooling, it can be understood that one for the orthogonal direction is considerably short. Since the ions can be ejected in high mass-precision within the short cooling time by setting the resonance excitation direction to the orthogonal direction 33 in the second trap section, a high duty cycle can be obtained. The ejected ions are detected by a detector 8.

Figure 9:
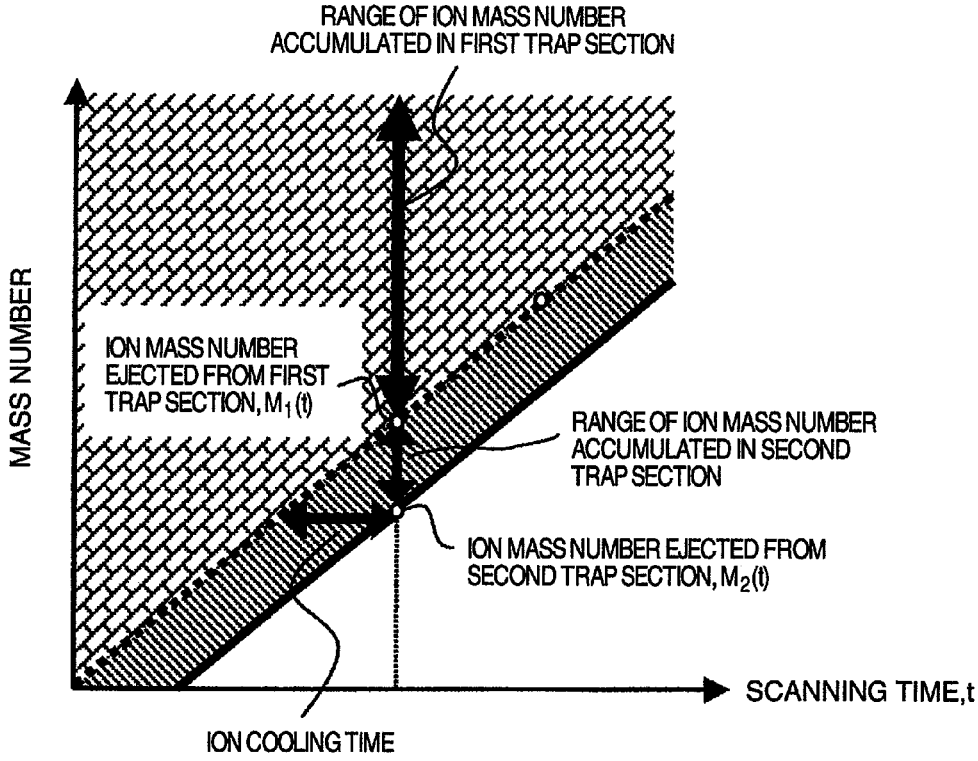
FIG. 9 A measuring sequence of the fifth embodiment of the present system.

The first trap section and the second trap section are controlled respectively in an interlinked manner. An example of the interlinked controls is shown in FIG. 9. An abscissa of FIG. 9 indicates time from a commencement of scanning and an ordinate of FIG. 9 indicates a mass number. Firstly, ions are mass-selectively ejected from the first trap section, and thereafter, mass-selective ejection is also commenced from the second trap section. Considering at a certain scanning time "t", only ions of masses between ion mass M1(t) which is ejected from the first trap section and ion mass M2(t) which is ejected from the second trap section are present in the second trap section. On the other hand, in a conventional ion trap, since all the ions whose masses exceed the ejection mass are accumulated within the ion trap, the space charge may easily occur, which limits the trapping capacity. In the present invention, such an interlinked control of the first trap section and the second trap section is carried out, so that the space charge can be considerably improved and the duty cycle can be improved.

In the above-described embodiment, by making the resonance excitation directions of the first trap section and the second trap section, which are entirely controlled in the interlinked manner, orthogonally intersected with each other, the energy distribution in the second trap section is minimized. However, if these resonance excitation directions are in a range between 60 degrees and 120 degrees, then there is an effect that the energy distribution is similarly reduced to lower than or equal to approximately 50%.

Also, while the linear ion trap of the present embodiment is configured by four pieces of the rod electrodes, by applying preferable AC voltages and DC voltages to these, the linear ion trap may be alternatively used as a quadrupole filter.

As a merit of the embodiment 5, the trapping capacity can be considerably improved compared with that of the conventional linear ion trap, so that the sensitivity thereof can be largely improved. On the other hand, the number of electrodes is increased and its cost is increased.

REFERENCE SIGNS LIST

1 - - - ion source, 2 - - - first narrow hole, 3 - - - second narrow hole, 5 - - - differentially-pumped section, 6 - - - vacuum chamber, 7 - - - trap chamber, 8 - - - detector, 10 - - - rod electrodes, 11 - - - end electrode, 12 - - - outer cylinder section, 13 - - - axial-direction potential forming-purpose vane electrodes, 14 - - - resonance exciting-purpose vane electrodes, 15 - - - trap wire electrode, 16 - - - trap wire electrode, 17 - - - extracting wire electrode, 18 - - - end electrode, 20 - - - vacuum pump, 21 - - - vacuum pump, 22 - - - narrow hole, 23 - - - narrow hole, 24 - - - axial-direction potential forming-purpose vane electrodes, 25 - - - resonance exciting-purpose vane electrodes, 26 - - - axial-direction potential forming-purpose vane electrodes, 27 - - - resonance exciting-purpose vane electrodes, 30 - - - auxiliary AC voltage, 31 - - - resonance excitation direction, 32 - - - auxiliary AC voltage, 33 - - - resonance excitation direction, 111 - - - electrically conductive rod electrode, 111 - - - end rod electrode, 112 - - - end rod electrode.

The invention claimed is:

1. A mass spectrometry apparatus comprising:

in a linear ion trap constructed of a plurality of quadrupole rod electrodes for performing mass-selective ejection, means for exciting ions along a first direction which orthogonally intersects a center axis of said rod electrodes; and means for forming an on-axis electric field along a second direction which orthogonally intersects the center axis of said rod electrodes and the first direction, wherein said first direction is a direction which connects a center of said quadrupole rod electrodes to an intermediate position of adjoining rod electrodes of said quadrupole rod electrodes, and wherein said means for forming the on-axis electric field along the second direction is means in which a direct current (DC) voltage is applied to a plurality of vane electrodes which are inserted between one pair of the adjoining rod electrodes of said quadrupole rod electrodes and whose distances from a center of said quadrupole rod electrodes vary.

2. The mass spectrometry apparatus as claimed in claim 1 wherein:

said means for exciting the ions along the first direction includes a plurality of vane electrodes inserted between said rod electrodes, to which an auxiliary alternating current (AC) voltage is applied.

3. The mass spectrometry apparatus as claimed in claim 1 wherein:

said means for exciting the ions along the first direction is means in which an auxiliary AC voltage is superposed over one pair of the adjoining rod electrodes of said quadrupole rod electrodes.

4. The mass spectrometry apparatus as claimed in claim 1 wherein:

a distance of said vane electrodes from a center axis on the ion introducing side of said linear ion trap is shorter than a distance of said vane electrodes from a center axis on the ion ejecting side thereof.

5. The mass spectrometry apparatus as claimed in claim 1, further comprising:

a trap wire electrode between said rod electrodes on the ion ejecting side within said quadrupole rod electrodes.

6. The mass spectrometry apparatus as claimed in claim 1, further comprising:

an end electrode on the ion ejecting side outside said quadrupole rod electrodes, for trapping ions by being applied with a voltage having a positive polarity.

7. The mass spectrometry apparatus as claimed in claim 1 wherein:

a plurality of said linear traps are set in a series manner.

8. The mass spectrometry apparatus as claimed in claim 7 wherein:

said ion excitation directions of said adjoining linear traps orthogonally intersect each other.

9. A mass spectrometry apparatus comprising:

an ion source;

a linear ion trap constructed of a plurality of quadrupole rod electrodes for mass-selectively ejecting ions introduced from said ion source; and a detector for detecting the ions ejected from said linear ion trap; wherein:

said linear ion trap is comprised of:

means for exciting ions along a first direction which orthogonally intersects a center axis of said rod electrodes;

means for forming an on-axis electric field along a second direction which orthogonally intersects the center axis of said rod electrodes and the first direction;

wherein said first direction is a direction which connects a center of said quadrupole rod electrodes to an intermediate position of adjoining rod electrodes of said quadrupole rod electrodes, and wherein said means for forming the on-axis electric field along the second direction is means in which a direct current (DC) voltage is applied to a plurality of vane electrodes which are inserted between one pair of the adjoining rod electrodes of said quadrupole rod electrodes and whose distances from a center of said quadrupole rod electrodes vary.

10. A mass spectrometry method with employment of a linear ion trap constructed of a plurality of quadrupole rod electrodes, comprising:

a step for introducing ions to said linear ion trap;

a step for accumulating the introduced ions in said linear ion trap;

a step for exciting the accumulated ions along a first direction which connects a center of said quadrupole rod electrodes to an intermediate position of adjoining rod electrodes of said quadrupole rod electrodes; and a step for forming an electric field along an axial direction of said quadrupole rod electrodes, and for converging the ions to a portion of said linear ion trap;

wherein:

mass-selective ejection of the ions is performed so as to detect ions; and wherein said first direction is a direction which connects a center of said quadrupole rod electrodes to an intermediate position of adjoining rod electrodes of said quadrupole rod electrodes, and wherein said step for forming the electric field includes applying a direct current (DC) voltage to a plurality of vane electrodes which are inserted between one pair of the adjoining rod electrodes of said quadrupole rod electrodes and whose distances from a center of said quadrupole rod electrodes vary.

11. The mass spectrometry method as claimed in claim 10 wherein:

an applied voltage for forming the electric field along said axial direction is made gradually greater so as to mass-selectively eject the ions.

12. The mass spectrometry method as claimed in claim 10 wherein:

said mass spectrometry method is comprised of a step for isolating ions of a specific mass of the accumulated ions; and a step for dissociating the isolated ion;

and wherein:

a step for forming an electric field along said quadrupole rod axial direction and for converging the ions to a portion of said linear ion trap is provided in front of said step for dissociating said ions.

13. The mass spectrometry method as claimed in claim 10 wherein:

a plurality of regions are provided which are divided by a trap electrode installed inside said linear ion trap;

ions introduced to a first region are excited along the first direction, and are mass-selectively ejected to a second region which exists beyond said trap electrode; and the ions ejected to said second region are excited along a second direction orthogonally intersecting said first direction, and the ions are mass-selectively ejected.

* * * * *